US006783231B1

(12) United States Patent
Kim

(10) Patent No.: US 6,783,231 B1
(45) Date of Patent: Aug. 31, 2004

(54) DEVICE AND METHOD FOR AUTOMATICALLY OPENING THE COVER OF AN IMAGE FORMING APPARATUS

(75) Inventor: Ihn-Kyung Kim, Seoul (KR)

(73) Assignee: Samsung Electronics Co., Ltd., Kyongki-do (KR)

( * ) Notice: Subject to any disclaimer, the term of this patent is extended or adjusted under 35 U.S.C. 154(b) by 0 days.

(21) Appl. No.: 08/921,355

(22) Filed: Aug. 29, 1997

(51) Int. Cl.[7] ..... B41J 29/13

(52) U.S. Cl. ..... 347/108; 399/25; 399/114; 399/124

(58) Field of Search ..... 399/22, 25, 124, 399/114; 347/104, 108; 292/144

(56) References Cited

U.S. PATENT DOCUMENTS

| | | | | |
|---|---|---|---|---|
| 4,176,941 A | | 12/1979 | Breitenkam et al. | |
| 4,231,567 A | | 11/1980 | Ziehm | |
| 4,786,041 A | | 11/1988 | Acquaviva et al. | |
| 4,908,655 A | | 3/1990 | Takagi | |
| 5,172,177 A | | 12/1992 | O'Dea et al. | |
| 5,182,595 A | | 1/1993 | Fukuchi et al. | |
| 5,228,680 A | | 7/1993 | Sugiura | |
| 5,307,116 A | | 4/1994 | Ikunami et al. | |
| 5,309,202 A | * | 5/1994 | Haneda et al. | 399/124 |
| 5,342,034 A | * | 8/1994 | Mandel et al. | 270/53 |
| 5,479,240 A | | 12/1995 | Lee et al. | |
| 5,580,046 A | | 12/1996 | Beaufort et al. | |
| 5,808,645 A | * | 9/1998 | Reeves et al. | 347/103 |

* cited by examiner

*Primary Examiner*—Arthur T. Grimley
*Assistant Examiner*—Greg Moldafsky
(74) *Attorney, Agent, or Firm*—Robert E. Bushnell, Esq.

(57) ABSTRACT

A device and method for automatically opening the cover of an ink-jet printer using a solenoid driving device, which responds to an electrical signal sent from a controller unit because the unit detected either a paper jam or that the ink cartridge is depleted. The new mechanism for automatically opening a printer cover allows the user to remove jammed paper or to replace the spent ink cartridge with greater speed and efficiency. This device has the advantages of being economical for use in ink-jet printers and employs a simple design which minimizes the need for repair and simplifies the manufacturing process.

12 Claims, 6 Drawing Sheets

DEVICE AND METHOD FOR AUTOMATICALLY OPENING THE COVER OF AN IMAGE FORMING APPARATUS

CLAIM FOR PRIORITY

This application makes reference to, incorporates the same herein, and claims all rights accruing thereto under 35 U.S.C. §121 through my patent application entitled Apparatus And Method For Automatically Opening A Cover Of An Ink-Jet Printer earlier filed in the Korean Industrial Property Office on the 29th day of August 1996 and there duly assigned Serial No. 1996/36565.

BACKGROUND OF THE INVENTION

1. Field of the Invention

The present invention relates to an apparatus and process for automatically opening a cover of an image forming apparatus, and particularly to an improved apparatus and process for automatically opening a cover of an image forming apparatus when there is a change in the operational readiness of the apparatus.

2. Description of the Related Art

In one method for transporting paper in a typical printer, a printing command is given and the paper feeding unit receives a control signal generated by the control unit and then loads the paper into the printer feeding unit. The paper is transported by rotating the feed roller so that the paper passes through the inside of the printer while ink is applied to the paper. One method for applying ink to the paper sprays the ink from a printer head, equipped with a plurality of minute nozzles, onto the paper. The operation of the printer head, along with the other printer operations, is controlled by signals generated by the control unit. After the ink has been applied, the paper is ejected through the ejection orifice of the printer by operation of the paper ejecting unit.

When an error is caused by a paper jam or by a shortage of ink, and the error is found by the user, the user must then follow a series of operations to resume printing. The user must open the cover of the printer, identify or confirm the cause of the error, take some action to correct the error, and then close the cover.

Some processes for simplifying the manual removal of jammed paper have been developed. U.S. Pat. No. 5,182,595 to Fukuchi entitled Image Forming Apparatus Having an Dismountable Process Cartridge, mentions a printer that automatically opens an upper printer cover and partially ejects a process cartridge when a paper jam is sensed. It also mentions the possibility of setting either its printer to open or its process cartridge to be partially ejected, or both, when an ink problem is detected. I have noticed, however, that the mechanism used by the Fukuchi '595 patent to allow a user to see the inside of the printer is a complicated two step process in which both the upper printer cover must be opened and the process cartridge partially ejected. The cover opening mechanism is a complicated combination of gears, micro-switches, and also uses a camming element inside the main body of the printer. It uses multiple gears to rotate the upper printer cover. This necessitates using a movable projection, connected to the rotation axis of the cover, to allow for the smooth rotation of the gear located at the axis.

U.S. Pat. No. 5,172,117 to O'Dea entitled Image forming Apparatus Having an Openable Sheet Guide, shows a printer with a top half that can be manually opened to allow rollers to separate and aid the user in removing the jammed paper.

The O'Dea '117 device requires manual action by the user to gain access to the interior of the printer.

U.S. Pat. No. 5,307,116 to Ikunami entitled Image Forming Apparatus Provided with Unit Locking Means, uses solenoids to lock portions of a copier in place and thereby prevent a lack of structural stability, due to the over extraction of components, and also to control the order in which a user is allowed to remove components from the copier. Ikunami '116 uses the solenoids merely as a restraint for different components of the copier. The solenoids can later be switched to an unlocked position so that the user may manually remove the corresponding part. The design of the solenoid switch causes a latch to rotate about an axis at the distal end, opposite the end on which the latch is located, by pulling on a point roughly midway along the latch with a solenoid. Ikunami '116 controls the order in which components can be removed by the user.

Various processes have been disclosed for locating the source of a paper jam. U.S. Pat. No. 4,908,655 to Takagi entitled Jam Detecting and Displaying Device in an Image Recording Apparatus, uses lights attached to the printer to help the user locate the paper jam. U.S. Pat. No. 4,176,941 to Breitenkam entitled Malfunction Display System for Electrophotographic Copying Machines, uses lights on a schematic diagram to aid users in identifying the cause of jams.

I have observed that when users unfamiliar with a printer have to remove a paper jam or replace an exhausted ink container that there is often difficulty in identifying and correcting the problem. I believe that an automatically opening printer cover would be a great aid to unfamiliar users and make their use of the printer more efficient. Ink-jet printers tend to be less expensive than other more advanced printers on the market today, but unfortunately, they also have a correspondingly lower profit margin on their sale. To be effective, I expect that the mechanism for opening the printer cover must be simple to construct and unlikely to malfunction or need repair. I have found that what is needed, but so far unaddressed by the art, is a new mechanism and process for automatically opening the cover when an error occurs, that is economical to construct, simple, and particularly well suited to the economic limitations, technological level and the physical configuration of a typical ink-jet printer, so as to aid the unfamiliar user in identifying and correcting printer errors.

SUMMARY OF THE INVENTION

It is an object of the current invention to provide a process and an apparatus for automatically opening the cover of an image forming apparatus.

It is another object to provide a simple mechanism capable of opening covers of image forming apparatuses such as an ink-jet printer.

It is still another object to provide a mechanism for opening the cover of an image forming apparatus that is simple to construct and unlikely to malfunction or need repair.

It is yet another object to provide a low cost mechanism for automatically opening the cover of an image forming apparatus.

It is yet still another object to provide a process by which covers of printers can be automatically opened when there is a paper jam or when the ink in the printer's ink cartridge is exhausted.

These and other objects may be achieved with a solenoid mechanism to automatically open the cover of an image formation device such as an inkjet printer. This mechanism uses a solenoid, an attached spring and a plurality of latches, and is both very simple and economic to use in lower profit margin printers, such as ink-jet printers. The design of the automatic cover opening mechanism is streamlined so as to require minimum maintenance. It is constructed with a movable latch located on the side of the main body of the printer that faces the inside of the printer cover. The non-interlocking side of the latch is attached to a spring that is fixed at its other end to a solenoid. A second stationary latch is fixed onto the inside of the printer cover and can be interlocked with the first latch. The solenoid separates the first latch, located on the side of the main body or the printer, from the second latch, located on the inside of the cover, by pulling the spring and thereby causing the latches to disengage in response to an electrical signal received from a controller unit.

A process for automatically opening a cover of an ink-jet printer according to the present invention may be practiced by using a sensing unit to make a determination of when a paper jam occurs; applying an electrical signal to a controller unit when a paper jam is detected; making a determination of whether ink is exhausted from the cartridge or other ink container; applying a second electrical signal to the controller unit when the exhaustion of ink is detected; and opening the cover of the printer after detaching the connecting unit by operating the solenoid, or other device, under the control of the controller unit in response to the first and second electrical signals.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood through the preferable embodiments referring to the attached drawings.

Figure 1:
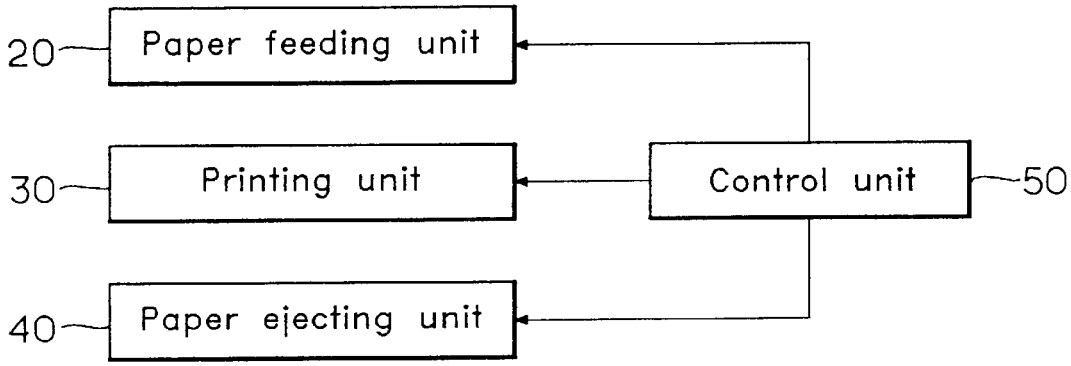
FIG. 1 is a simplified block diagram roughly showing the construction of an exemplary ink-jet printer.

As shown in FIG. 1, an ink-jet printer includes a paper feeding unit 20 for transporting a sheet of paper into the printer. A printing unit then performs the printing operation on the paper while it is being transported through the printer. Then, a paper ejecting unit ejects the paper from the printer ejection orifice. The coordination and monitoring of these operations is performed using a control unit that generates a control signal for each phase of the process—feeding the paper into the printer; placing ink on the paper; and ejecting the paper from the printer.

Figure 2:
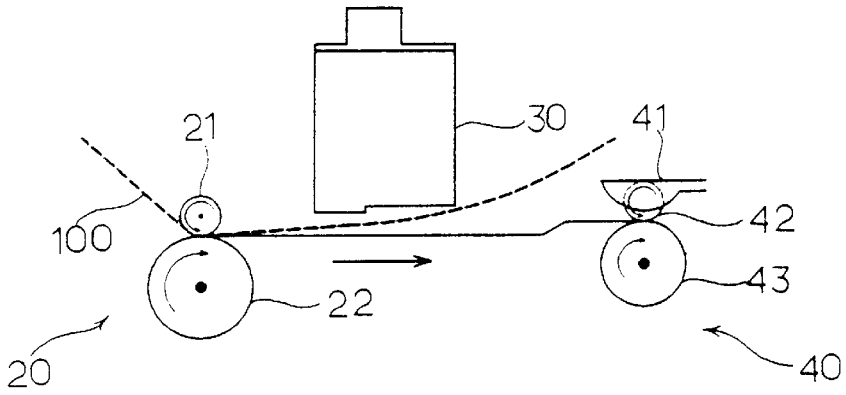
FIG. 2 is a cross-sectional view showing a path of paper transportation through a conventional ink-jet printer.

The paper feeding unit 20, as shown in FIG. 2, includes a line feed (LF) motor (not illustrated) driven by a control signal from the control unit 50. The line feed motor drives the feed roller 22. The feed roller is in frictional contact with a friction roller 21 so that it is driven by the rotation of the feed roller. Thus, the line feed motor drives both the feed roller and the friction roller. The paper feeding unit 20 is located at the side of the paper feeding mechanism used by the printer. The paper 100 passes between the rotating feed roller 22 and friction roller 21 and it is then transported inside of the printer.

The line feed motor is a stepping motor driven by signals sent from the control unit. The line feed motor rotates the feed roller 22 and transports the paper through the paper transporting section inside the printer. The printing operation is performed by the printing head when the paper 100 passes the head during transport.

Figure 3:
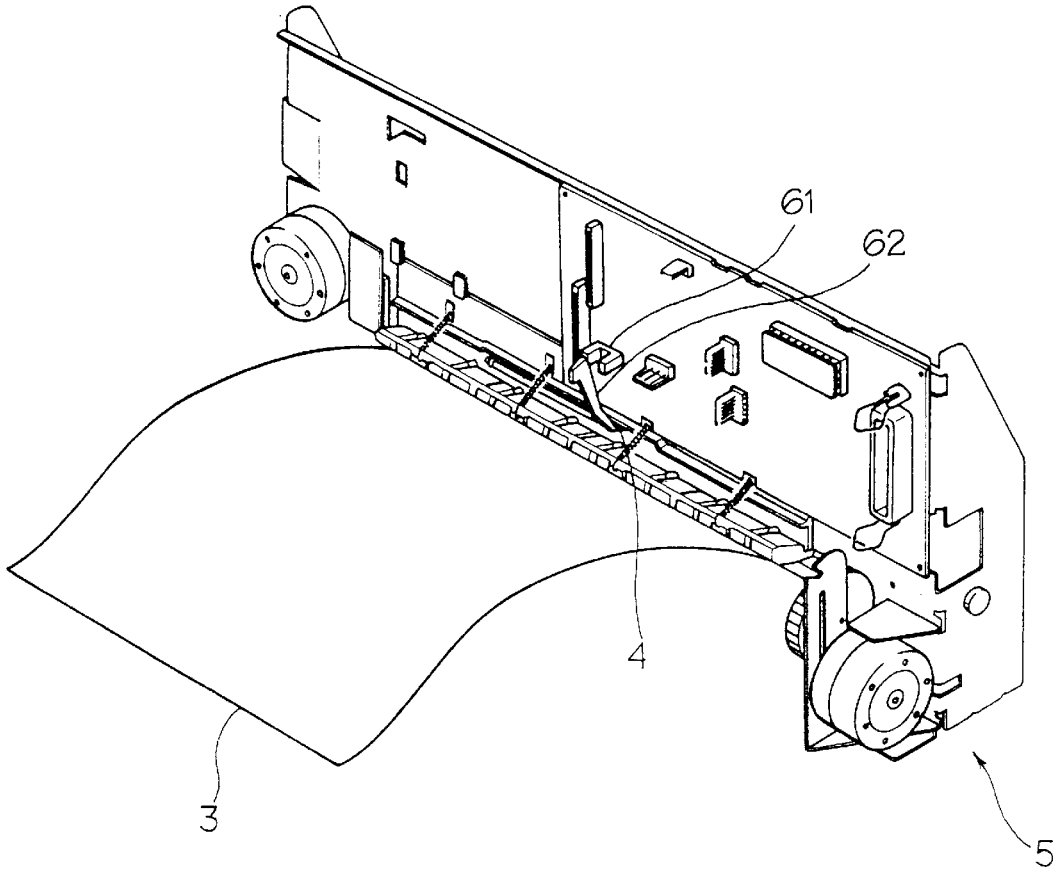
FIG. 3 is a perspective view showing the construction of an apparatus for sensing the occurrence of a paper jam in a conventional ink-jet printer.

The paper ejecting unit 40 may be constructed with an eject-roller 43 for ejecting the paper after it has been printed upon and transported to the ejection orifice: a star-wheel 42 which is rotated by being in contact with the eject-roller 43; and a guide star-wheel 41 of semicircle type which fixes the rotating axis of the star-wheel 42. The paper ejecting unit 40 is located at the side of the ejection orifice. The transported paper 100 is guided between the star-wheel 42 and the eject roller 43 by the guide star-wheel 41. The shape of the guide star wheel causes the paper edge to be guided to the interface between star wheel and the eject-roller. When a printer has the paper transportation interrupted because paper has become crumpled in the printer its operation terminates. The proper timing of the paper transport is performed using the apparatus shown in FIG. 3.

The apparatus for sensing a paper jam includes a pair of optical sensors 61 located on the main body of the printer 5; a movable actuator 62 inserted between the pair of optical sensors; and a spring (not illustrated) for restoring the actuator 62 to its resting position. The apparatus for noting the passage of paper operates by sending a signal whenever paper is transported past the apparatus. After a printing command is given, paper 3 is loaded into the printer, printed on, and then fed through the printer towards the ejection orifice. While the paper is in transport it rotates the actuator 62 by pulling the actuator 62 around a centering axis 4. The moving of the actuator allows light to be passed between the optical sensors thereby causing an electric signal to be generated. This allows the transporting of paper to be sensed at a predetermined point in the operation and the timing of its passage (from the feeder unit to the actuator) to be compared with the correct time for such operations under normal operating conditions. After the paper 3 completely passes the actuator 62, the actuator 62 returns to the original position due to a restoring force provided by a spring. Once returned to its original position the actuator interrupts the light transmission between the optical sensors and thereby terminates the signal. When the printing operation is not being performed, the actuator 62 is in its default position and rests between the pair of optical sensors thereby blocking any light they could transmit between-themselves.

Figure 4:
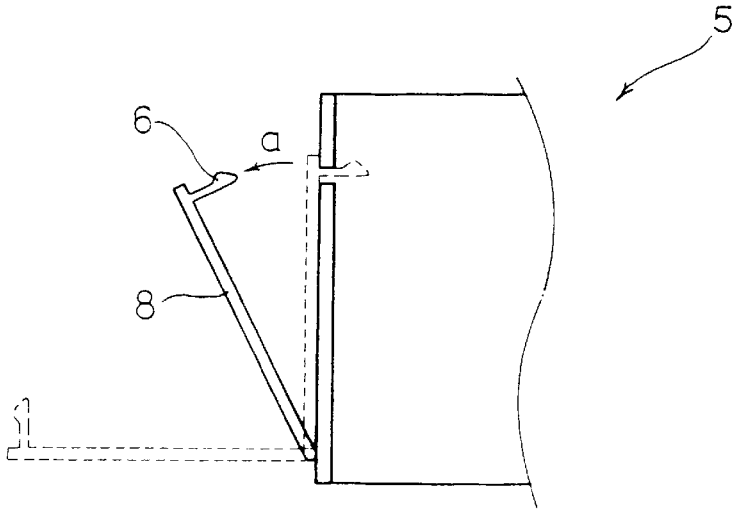
FIG. 4 is a cross-sectional view showing the operation of opening and closing a cover for a typical ink-jet printer.

If for some reason the paper being operated upon by the printer does not pass through during a predetermined time, the actuator 62 is not rotated and the pair of optical sensors 61 does not generate an electrical signal at the appropriate time. The controller unit senses the lack of an appropriate signal and interprets it as a paper jam. The controller unit stops the printing operation and activates an alarm or other error display mechanism to alert the user to the paper jam. When the printing is not performed because of a shortage of ink in the cartridge, an appropriate error is communicated to the user using the display unit of the printer or displaying the error on a monitor (not illustrated) a predetermined set of operations. When an error caused by the paper jam or shortage of ink is generated, a cover 8 of the printer 5 having a hooking lug 6 as shown in FIG. 4 is pulled in the direction of 'a'. After opening the cover 8, a user confirms the cause of the error and takes action to remove the cause of the error, and closes the cover 8.

Figure 5:
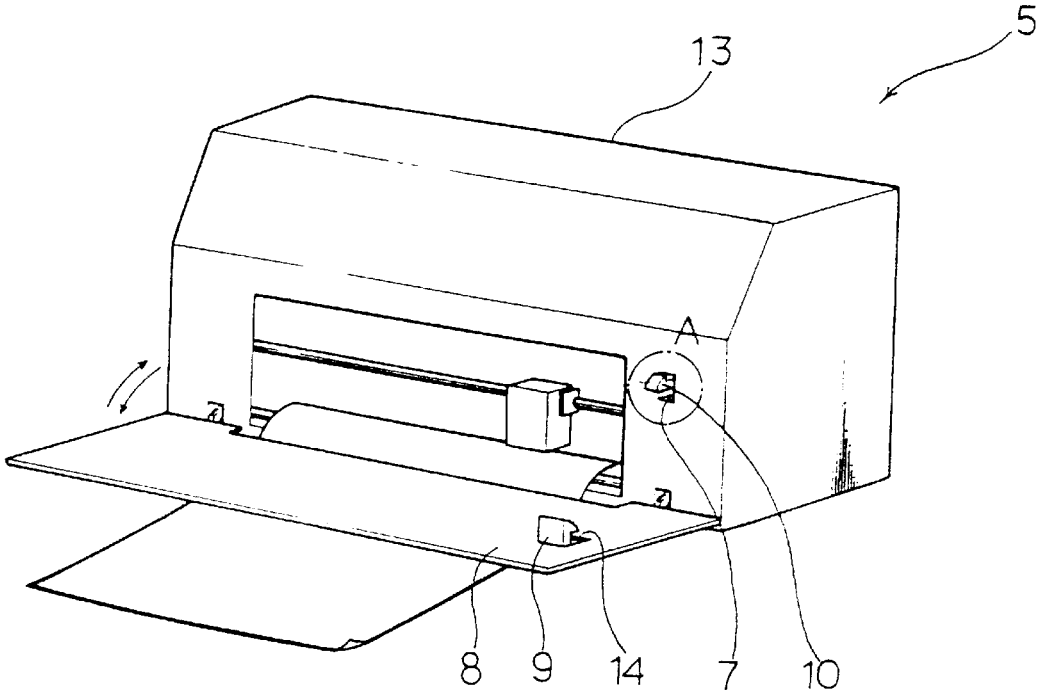
FIG. 5 is a perspective view showing a printer having an apparatus for automatically opening a cover of an ink-jet printer constructed in accordance with the principles of the present invention.

FIG. 5 is a perspective view showing an ink-jet printer utilizing the current mechanism for automatically opening a cover according to the present invention. As shown in the drawing, the printer cover 8 is hingedly connected to the main body 13 of the printer 5. A hole 7 is formed at the front of the main body 13 of the printer 5. The interlocking portion of the movable latch 10 protrudes through hole 7. A movable latch 10 interlocks with a fixed latch 9, which is attached to the inside of the printer cover, when the cover is in its normal operating position. The cover has a recess 14 corresponding to the interlocking portion of the moveable latch that extends through hole 7. A recess is also located on the cover 8 of the printer 5. A latch 9 is attached to the inside of the cover 8 and is located along the upper portion of recess 14. When the cover is in the closed position the latches rest in an interlocked position inside of the cavity made by recess 14 and hole 7.

Figure 5A:
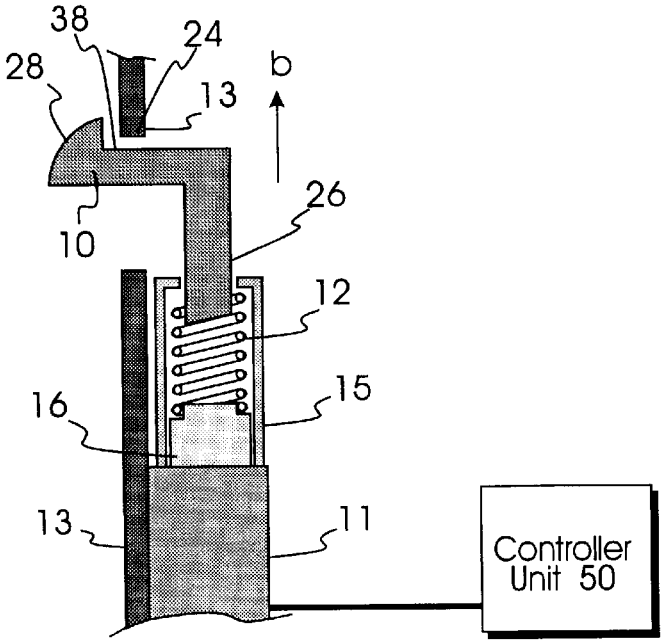
FIG. 5A is a cross-sectional view of enlarged portion A the releasing mechanism which is shown installed on the ink-jet printer in FIG. 5.
Figure 6A:
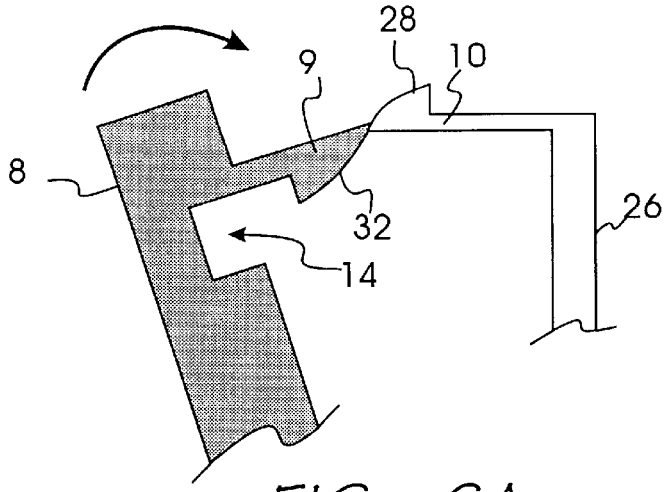
FIG. 6A shows two latches constructed according to the principles of the present invention as the latches first make contact and begin to slide along each other's surfaces in a camming action.
Figure 6B:
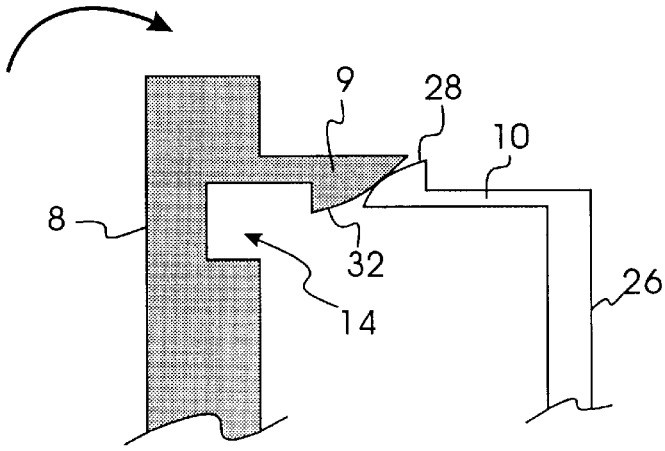
FIG. 6B shows the progression of the camming action as the two latches illustrated in FIG. 6A are engaging.
Figure 6C:
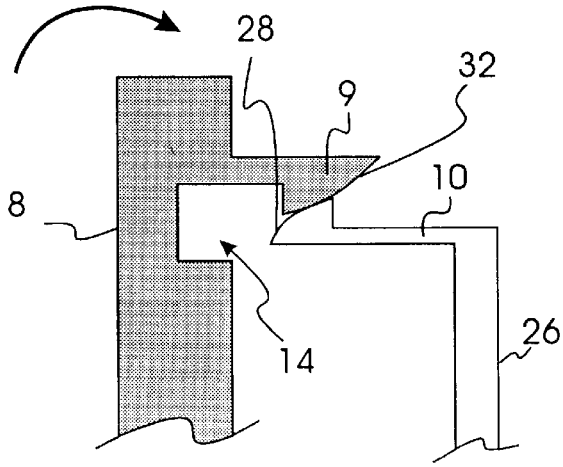
FIG. 6C shows the latches illustrated in FIG. 6A just prior to the completion of the camming action and just prior to the interlock position.
Figure 7:
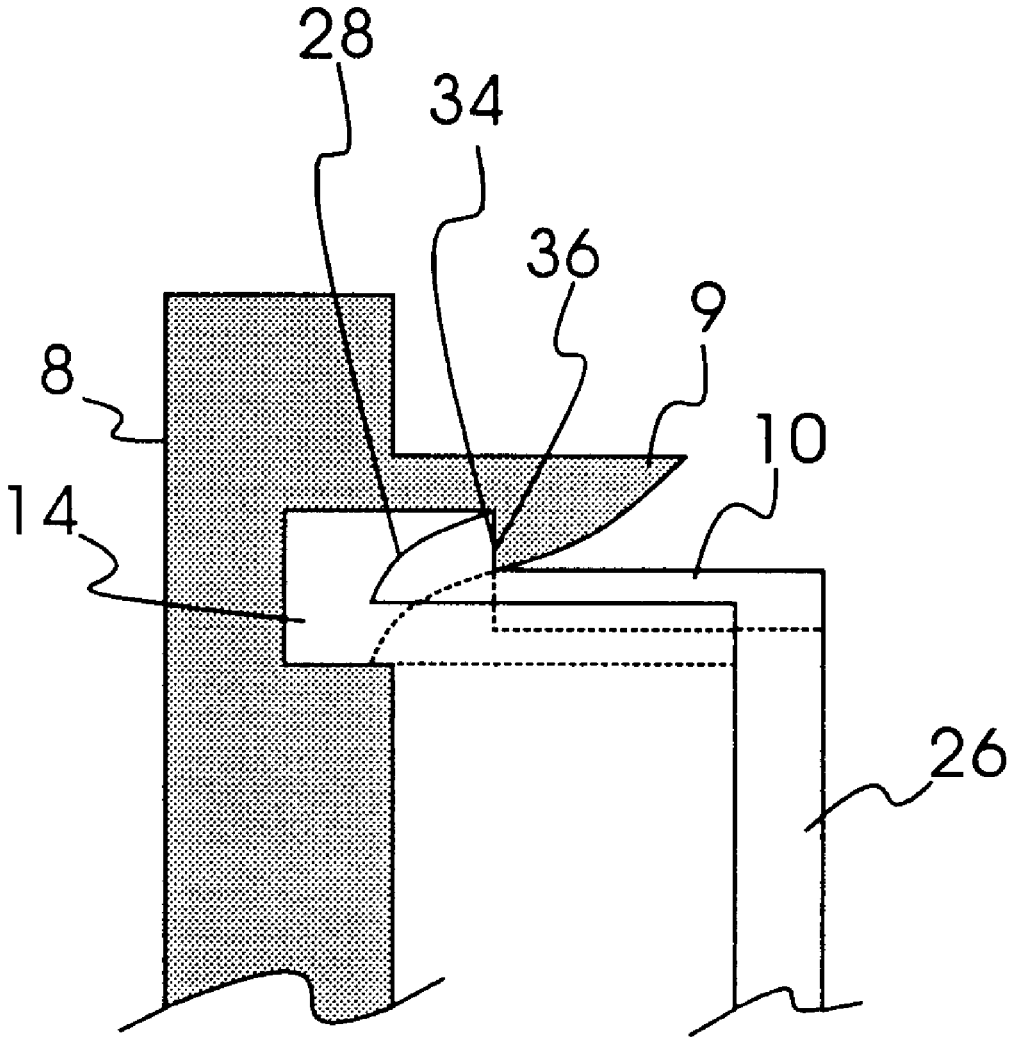
FIG. 7 is a cross-sectional view showing the final interlock position between the two latches when the printer cover is in the closed position.

As illustrated in FIG. 5A, the latch 10 protrudes through the hole in the body of the printer. The interior portion of the movable latch 26 connects to the movable end 16 of a solenoid 11 by way of an interposed spring 12 between the two. One end of spring 12 is attached to the latch 10 and the other end of the spring is attached to the movable end 16 of the solenoid 11. This causes the movable latch 10 on the main body of the printer to always have a force exerted upon it in the direction denoted in FIG. 5A. This causes a part of the latch 38 to contact part of the main body of the printer 24 while in its non interlocked default position. The movable latch 10 on the main body of the printer is oriented so as to interface with the fixed latch 9 on the inside of the printer cover. The distances of the latches in their default position, as measured from the base of the printer, are such that they will slide along the surface of each other in a camming action and then interlock. The sliding contact between the movable latch 10 and the fixed latch 9 occurs in a camming fashion along surfaces 28 and 32, respectively, as the printer cover is closed, as shown in FIGS. 6A–6C. After the sliding contact is over the two latches interlock and hold the printer cover in the closed position. To maintain the interlocked position the latch 10 on the side of the main body is pressed in the direction illustrated in FIG. 5A by a spring 12. While interlocked, the two latches occupy the cavity created by both the recess in the cover and the through hole in the printer body. FIG. 7 shows this interlock position and a prior sliding contact position, denoted by the dotted lines, and also illustrates how the latches occupy the cavity created by both the recess 14 in the printer cover and the hole 7 in the main body of the printer (main body of the printer and through the corresponding hole not included in the figure). FIG. 7 further shows the contacting surfaces of the latches when they are in the interlocked position 34 and 36.

Figure 8:
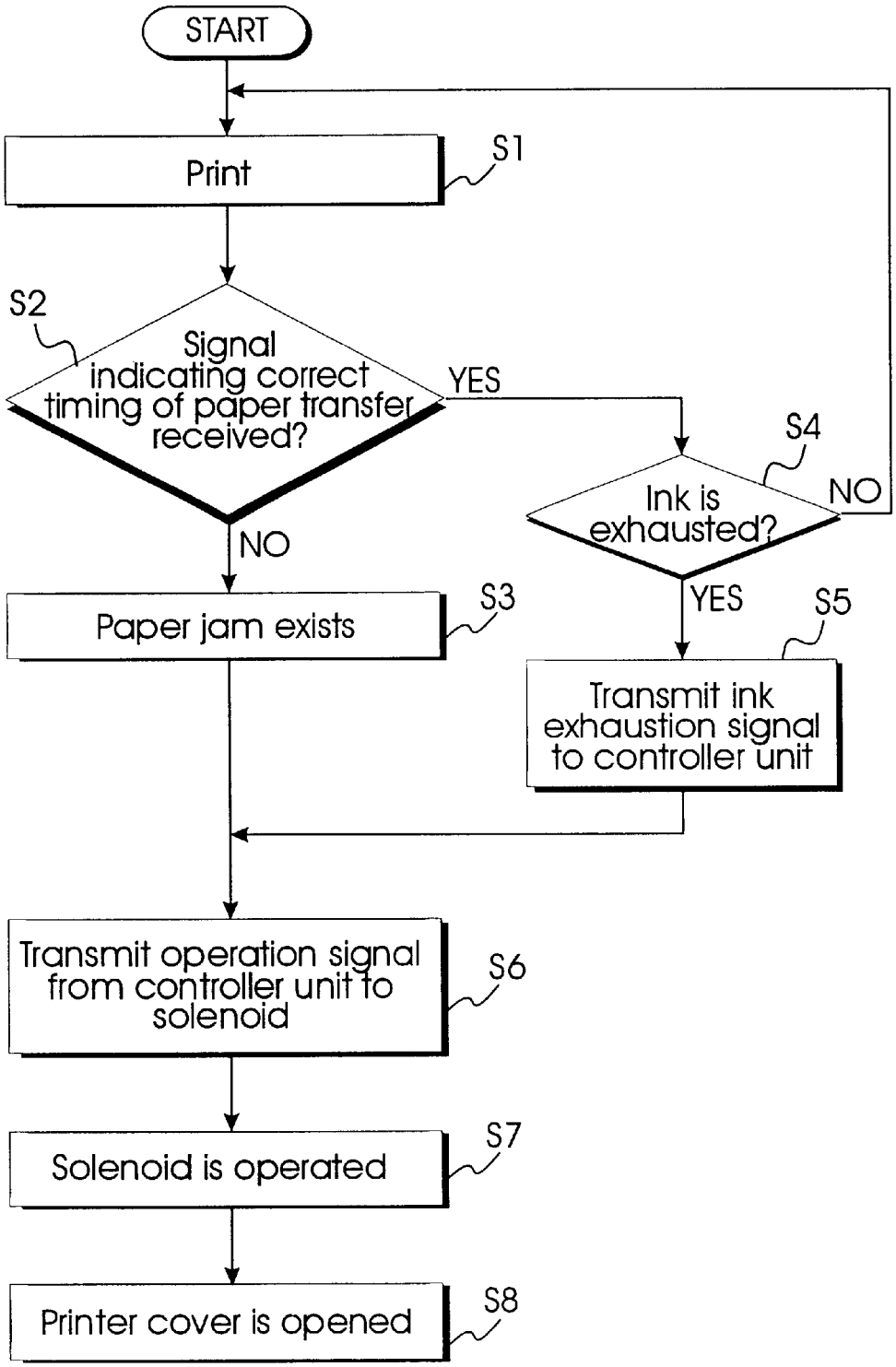
FIG. 8 is a flowchart showing a method for automatically opening the cover of an ink-jet printer in accordance with the principles of the current invention.

The flowchart in FIG. 8 illustrates the method of operation for automatically opening the door of an ink-jet printer using the current inventive device. Once the control unit starts the printing operation in step S1 it waits for the appropriate signal to confirm a lack of paper jamming in step S2. The signal is sent when the pair of optical sensors are no longer blocked by the actuator, as explained above.

When the controller detects a paper jam, due to the lack of a signal from the optical sensors at the appropriate time, it transmits the operating signal to the solenoid 11 in step S6 (also stopping the printing process and carrying out the appropriate error notification operations for the user). Then the solenoid is activated in step S7, which then pulls on the spring, thereby disconnecting the interlocking latches. Once the latches are no longer interlocked the printer cover is opened by gravity due to the design of the printer body, or by an impulse provided by any impulse creating mechanism in step S8.

FIGS. 5A and 7 illustrate how one embodiment of the current apparatus invention performs the printer cover opening operation. When an error signal is received by the solenoid 11, the movable end 16 of the solenoid 11 is lowered which pulls the attached spring 12 in the '-b' direction. This pulls the latch 10, which is fixably connected to the spring, in the '-b' direction and disconnects one latch from the other. After they are disconnected, the printer cover 8 is automatically opened by an impulse created by the elasticity of the hinged elastic connection between the printer cover and the main body 13.

When a signal indicating the passage of paper is sent at the appropriate time from the optical sensors the controller does not detect a paper jam and so it then determines in step S4 whether the printer's ink is exhausted. When the ink sensing mechanism determines in step S5 that the ink is exhausted a signal is sent to the controller unit. The controller unit then activates the solenoid and thereby causes the printer cover to open, as explained above (steps S6, S7, and S8). When the printing process occurs without error the printer continues to operate normally by returning to step S1.

The opening of the printer cover, when an error occurs, combined with the user error messages that are generated when the paper is jammed during printing or the ink in a cartridge is exhausted, allow a user to remove jammed paper or exchange an ink cartridge more simply and efficiently. This facilitates resolution of technical problems and increases the productivity of the printer's operation. The current invention utilizes an ideal ink-jet printer cover opening mechanism which provides the above benefits to the user.

The foregoing paragraphs describe a mechanism that is simpler than any mechanism used in the art for the automatic opening of printer covers. This invention also has the advantages of being very easy to construct, being manufacturable at a low cost and requiring a minimum of maintenance or repairs. The shape of the mechanism is ideal for fitting inside the typical ink-jet printer and can be placed in an area inside the printer currently devoid of any printer components. Although one preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. An apparatus for automatically opening a cover of an ink-jet printer, comprising:

connecting means for opening a cover of a main body of the printer;

paper sensing means located on said main body of said apparatus for generating a predetermined electrical signal in the case of a paper jam;

driving means for driving said connecting means; and control means electrically connected to said apparatus for automatically opening the cover by activating said driving means to drive said connecting means.

2. The apparatus of claim 1, wherein said connecting means comprises:

a connecting part on a side of the main body which has one end movably connected to said driving means; and a connecting part on a side of the cover which has one end fixed to said cover and the other end connected to said connecting part on the side of the main body.

3. The apparatus of claim 2, wherein said connecting part on the side of the main body comprises a first hooking lug, and an elastic body having one end fixed at said first hooking lug and the other end connected to said driving means; and said connecting part on the side of the cover comprises a second hooking lug.

4. The apparatus of claim 3, wherein said elastic body includes a spring.

5. The apparatus of claim 3, wherein said driving means includes a solenoid.

6. The apparatus of claim 5, wherein said solenoid pulls said elastic body in response to the electrical signal outputted from said sensing means.

7. A method for automatically opening a cover of an ink-jet printer, comprising:

a first determining step for determining a paper jam using sensing means;

a step for applying a first electrical signal to a central processing unit, in the case that the paper jam is sensed in said first determining step;

a second determining step for determining an exhaustion of ink amount, in the case that the paper jam is not sensed in said first determining step;

a step for applying a second electrical signal to said central processing unit, in the case that the exhaustion of ink amount is sensed in said second determination step; and a step for automatically opening the cover of the printer after detaching connecting means by operating a solenoid under the control of said central processing unit in response to either said first and said second electrical signals.

8. The method of claim 7, wherein said connecting means comprises:

a connecting part on a side of the main body having a first hooking lug and an elastic body which has one end fixed to said first hooking lug and the other end connected to said solenoid; and a connecting part on a side of the cover having a second hooking lug which has one end fixed to the cover of the printer and the other end connected to said first hooking lug.

9. An ink jet printer, comprising:

a main body comprising internal components and a chassis surrounding said internal components;

a cover attached to said main body allowing easy access to said internal components of said main body;

connectors to open said cover from said main body of said printer;

a paper sensor located on said main body to generate a first electrical signal in the presence of a paper jam;

an ink sensing mechanism located in said main body to generate a second electrical signal when ink is exhausted;

a driver that drives said connectors; and a controller unit electrically connected to said printer that automatically opens said cover by activating said driver to drive said connectors to separate in response to either one of said first electrical signal and said second electrical signal.

10. The printer of claim 9, said internal components comprises an ink cartridge that is sensed by said ink sensing mechanism.

11. The printer of claim 10, said connectors comprises a pair of interlocking latches, one of said pair of interlocking latches being integral with said main body which has one end movably connected to said driver and the other one of said pair of interlocking latches is formed integral with said cover.

12. The printer of claim 11, said driver comprises a solenoid that responds to either one of said first electrical signal and said second electrical signal to pull apart said pair of interlocking latches allowing said cover to automatically open and allow easy access to said internal components of said main body in the absence of user intervention.

* * * * *